US012127686B2

(12) United States Patent
Chen et al.

(10) Patent No.: US 12,127,686 B2
(45) Date of Patent: Oct. 29, 2024

(54) FOLDABLE CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 341 days.

(21) Appl. No.: 17/573,504

(22) Filed: Jan. 11, 2022

(65) Prior Publication Data

US 2023/0165373 A1 Jun. 1, 2023

(30) Foreign Application Priority Data

| | | |
|---|---|---|
| Nov. 27, 2021 | (CN) | 202111425809.5 |
| Nov. 27, 2021 | (CN) | 202122992938.4 |
| Nov. 29, 2021 | (CN) | 202122961435.0 |
| Nov. 29, 2021 | (CN) | 202122963343.6 |

(51) Int. Cl.
*A47C 4/30* (2006.01)
*A47C 4/28* (2006.01)

(52) U.S. Cl.
CPC ..... *A47C 4/30* (2013.01); *A47C 4/286* (2013.01)

(58) Field of Classification Search
CPC ..... A47C 4/286
See application file for complete search history.

(56) References Cited

U.S. PATENT DOCUMENTS

| | | | | |
|---|---|---|---|---|
| 2019/0290007 | A1* | 9/2019 | Chen | |
| 2021/0212471 | A1* | 7/2021 | Chen | A47C 4/286 |

FOREIGN PATENT DOCUMENTS

| | | | | |
|---|---|---|---|---|
| CN | 210249188 U | | 4/2020 | |
| CN | 212995495 U | * | 4/2021 | A47C 4/286 |
| CN | 213849654 U | * | 8/2021 | A47C 4/286 |

* cited by examiner

*Primary Examiner* — Anthony D Barfield
(74) *Attorney, Agent, or Firm* — Bayramoglu Law Offices LLC

(57) ABSTRACT

A folding chair is provided. The folding chair includes two mirror-symmetric slant support mechanisms and a linkage mechanism connected between the two slant support mechanisms, where the slant support mechanisms each include two slant support posts and two bottom frame posts; the linkage mechanism includes two linkage posts that cross each other and are hinged; upper ends of the two slant support posts and an upper end of a linkage post are hinged to a first connecting member; first ends of the two bottom frame posts are respectively hinged to the two slant support posts, and second ends of the two bottom frame posts are hinged; lower ends of the two linkage posts are respectively connected to the two slant support mechanisms; the folding chair further includes a pressing mechanism and a cushion.

44 Claims, 15 Drawing Sheets

FOLDABLE CHAIR

CROSS REFERENCE TO THE RELATED APPLICATIONS

This application is based upon and claims priority to Chinese Patent Application No. 202111425809.5, filed on Nov. 27, 2021, No. 202122992938.4, filed on Nov. 27, 2021, No. 202122961435.0, filed on Nov. 29, 2021, No. 202122963343.6, filed on Nov. 29, 2021 the entire contents of which are incorporated herein by reference.

TECHNICAL FIELD

The present invention relates to the technical field of chairs, and in particular to a folding chair.

BACKGROUND

Folding chairs are popular due to their space-saving feature after being folded. Compared with ordinary folding chairs, the structure of folding rocking chairs is more complicated, and the prior products are able to achieve folding and unfolding. After being unfolded, the folding chair is usually locked by a locking mechanism to prevent it from being folded during use. However, the locking mechanism is prone to locking failure, which causes the folding chair to be unstable in use, leading to potential safety hazards. For this reason, it is necessary to manually check whether the locking mechanism is working properly. In addition, to fold the folding chair, the locking mechanism must be released. Thus, the processes of unfolding and folding of the folding chair are cumbersome.

SUMMARY

In order to solve the problem of the cumbersome processes of unfolding and folding the existing folding chair, the present invention provides a folding chair.

In order to solve the above technical problem, the present invention adopts the following technical solution. A folding chair includes two mirror-symmetric slant support mechanisms and a linkage mechanism connected between the two slant support mechanisms, where the slant support mechanisms each include two slant support posts and two bottom frame posts; the linkage mechanism includes two linkage posts that cross each other and are hinged; upper ends of the two slant support posts and an upper end of a linkage post are hinged to a first connecting member; first ends of the two bottom frame posts are respectively hinged to the two slant support posts, and second ends of the two bottom frame posts are hinged; lower ends of the two linkage posts are respectively connected to the two slant support mechanisms; the folding chair further includes a pressing mechanism and a cushion; when the folding chair is unfolded and the cushion carries an object, the pressing mechanism transmits a weight received by the cushion to first connecting members; the second ends of the two bottom frame posts are hinged to a fourth connecting member, and the lower ends of the linkage posts are respectively hinged to fourth connecting members; the folding chair further includes two mirror-symmetric standing posts; the first connecting members are respectively slidable on the standing posts; the pressing mechanism includes two support posts; the two support posts are respectively supported on two sides of the cushion; the support posts are respectively connected to the standing posts and transmit the weight received by the cushion to the first connecting members; hanging straps are connected to the two sides of the cushion; and the support posts are respectively connected to the hanging straps through sixth connecting members to support the hanging straps.

In a solution, the standing posts may be respectively inserted into the support posts, and the support posts may be movable along the standing posts; when the folding chair may be unfolded and the cushion carries an object, bottom parts of the support posts respectively press the first connecting members; the linkage posts may be respectively fixed with fifth connecting members at portions close to the lower ends thereof; lower ends of the standing posts may be respectively hinged to the fifth connecting members; alternatively, the lower ends of the standing posts may be respectively fixed to the fourth connecting members; and lower ends of the slant support posts may be respectively hinged to the first ends of the bottom frame posts through second connecting members.

In a solution, the standing posts may be respectively provided with buckles; the support posts may be respectively connected to the standing posts through the buckles, and the support posts may be movable in the buckles; when the folding chair may be unfolded and the cushion carries an object, bottom parts of the support posts respectively press the first connecting members; the linkage posts may be respectively fixed with fifth connecting members at portions close to the lower ends thereof; lower ends of the standing posts may be respectively hinged to the fifth connecting members; alternatively, the lower ends of the standing posts may be respectively fixed to the fourth connecting members; and the lower ends of the slant support posts may be hinged to base plates; the third connecting members may be respectively fixed to the slant support posts; and the first ends of the bottom frame posts may be respectively hinged to the third connecting members.

A folding chair includes two mirror-symmetric slant support mechanisms and a linkage mechanism connected between the two slant support mechanisms, where the slant support mechanisms each include two slant support posts and two bottom frame posts; the linkage mechanism includes two linkage posts that cross each other and are hinged; upper ends of the two slant support posts and an upper end of a linkage post are hinged to a first connecting member; first ends of the two bottom frame posts are respectively hinged to the two slant support posts, and second ends of the two bottom frame posts are hinged; lower ends of the two linkage posts are respectively connected to the two slant support mechanisms; the folding chair further includes a pressing mechanism and a cushion; when the folding chair is unfolded and the cushion carries an object, the pressing mechanism transmits a weight received by the cushion to first connecting members; the folding chair further includes two mirror-symmetric standing posts; the second ends of the two bottom frame posts are hinged to a portion of the standing post close to a lower end; and the lower ends of the linkage posts are respectively hinged to the fourth connecting members; the first connecting members are respectively slidable on the standing posts; the pressing mechanism includes two support posts; the two support posts are respectively supported on two sides of the cushion; the support posts are respectively connected to the standing posts and transmit the weight received by the cushion to the first connecting members; the first connecting members each are provided with limit grooves, and the upper ends of the slant support posts are respectively hinged in the limit grooves; the fourth connecting members are respectively provided with support grooves, and the lower ends of the linkage posts are respectively hinged in the support grooves; the lower ends of the standing posts are respectively fixed to the fourth connecting members; and hanging straps are connected to the two sides of the cushion; and the support posts are respectively connected to the hanging straps through sixth connecting members to support the hanging straps. the slant support mechanisms each further include second connecting members and a seventh connecting member; the second connecting members are respectively fixed to the first ends of the bottom frame posts; portions of the slant support posts close to the lower ends are respectively hinged to the second connecting members; the seventh connecting member is fixed to the second ends of the bottom frame posts; portions of the standing posts close to the lower ends are respectively hinged to seven connecting members; and the folding chair further includes base plates fixed to the lower ends of the slant support posts.

In a solution, the standing posts may be respectively inserted into the support posts, and the support posts may be movable along the standing posts; when the folding chair may be unfolded and the cushion carries an object, bottom parts of the support posts respectively press the first connecting members.

In a solution, the standing posts may be respectively provided with buckles; the support posts may be respectively connected to the standing posts through the buckles, and the support posts may be movable in the buckles; and when the folding chair may be unfolded and the cushion carries an object, bottom parts of the support posts respectively press the first connecting members.

A folding chair includes two mirror-symmetric slant support mechanisms and a linkage mechanism connected between the two slant support mechanisms, where the slant support mechanisms each include two slant support posts and two bottom frame posts; the linkage mechanism includes two linkage posts that cross each other and are hinged; upper ends of the two slant support posts and an upper end of a linkage post are hinged to a first connecting member; first ends of the two bottom frame posts are respectively hinged to the two slant support posts, and second ends of the two bottom frame posts are hinged; lower ends of the two linkage posts are respectively connected to the two slant support mechanisms; the folding chair further includes a pressing mechanism and a cushion; when the folding chair is unfolded and the cushion carries an object, the pressing mechanism transmits a weight received by the cushion to first connecting members; the second ends of the two bottom frame posts are hinged to a fourth connecting member; the folding chair further includes two connecting posts; the lower ends of the two linkage posts are respectively hinged to the two connecting posts; first ends of the two connecting posts are hinged by a hinge; the folding chair further includes two mirror-symmetric standing posts; the first connecting members are respectively slidable on the standing posts; the pressing mechanism includes two support posts; the two support posts are respectively supported on two sides of the cushion; the support posts are respectively connected to the standing posts and transmit the weight received by the cushion to the first connecting members; the lower ends of the linkage posts are respectively hinged to eighth connecting members; the eighth connecting members are respectively fixed to the connecting posts; the standing posts are respectively hinged to the connecting posts; the lower ends of the standing posts are respectively fixedly connected to the fourth connecting members; hanging straps are connected to the two sides of the cushion; and the support posts are respectively connected to the hanging straps through sixth connecting members to support the hanging straps; the slant support mechanisms each further include second connecting members and base plates; the base plates are respectively fixed to the lower ends of the slant support posts; the second connecting members are respectively fixed to the first ends of the bottom frame posts; portions of the slant support posts close to the lower ends are respectively hinged to the second connecting members; the folding chair further includes a fastener and a lock pin; and the fastener and the lock pin are respectively arranged on the two first connecting members.

In a solution, the standing posts may be respectively inserted into the support posts, and the support posts may be movable along the standing posts; when the folding chair may be unfolded and the cushion carries an object, bottom parts of the support posts respectively press the first connecting members.

In a solution, the standing posts may be respectively provided with buckles; the support posts may be respectively connected to the standing posts through the buckles, and the support posts may be movable in the buckles; when the folding chair may be unfolded and the cushion carries an object, bottom parts of the support posts respectively press the first connecting members.

The present invention has the following beneficial effects. The folding chair is provided with the first connecting members, the slant support mechanisms and the pressing mechanism. The pressing mechanism supports the cushion of the folding chair and transmits the weight received by the cushion to the first connecting members. The first connecting members are pressed to make the slant support mechanisms unfolded and maintain a stable unfolded state. When the folding chair needs to be folded, the pressing mechanism is removed, such that the first connecting members are movable upward along the standing posts, which is convenient for folding the folding chair.

BRIEF DESCRIPTION OF THE DRAWINGS

The present invention is described in further detail below with reference to the drawings and embodiments.

Figure 1:
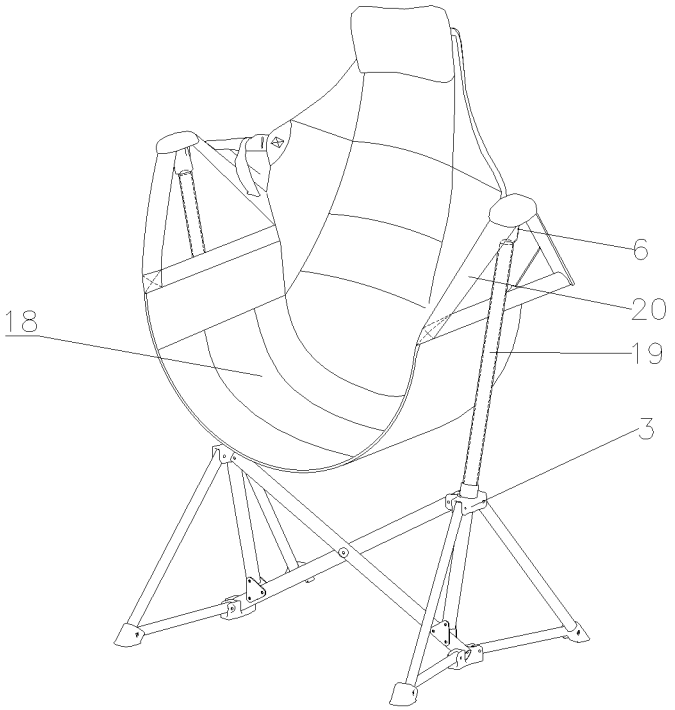
FIG. 1 is a structural view of a folding chair according to a first embodiment of the present invention.
Figure 2:
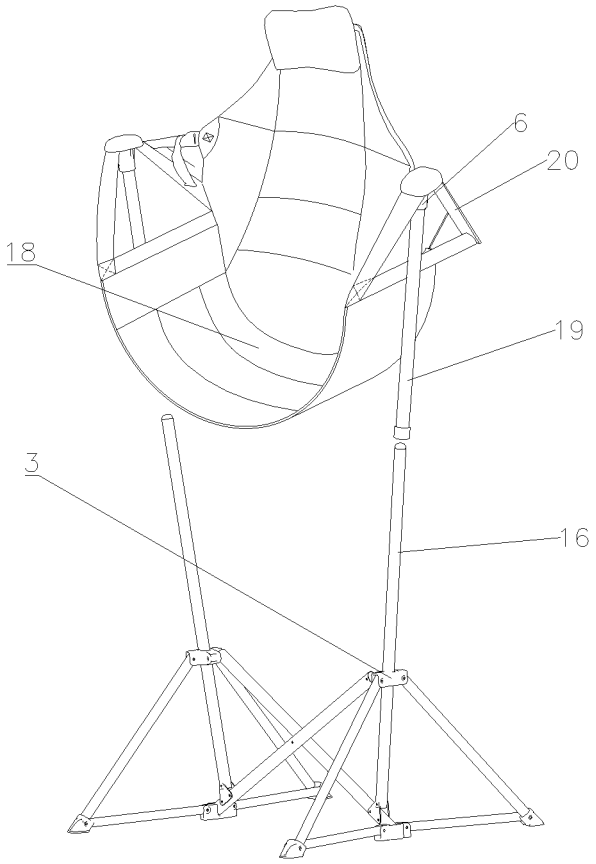
FIG. 2 is a structural view of the folding chair in a disassembled state according to the first embodiment of the present invention.
Figure 3:
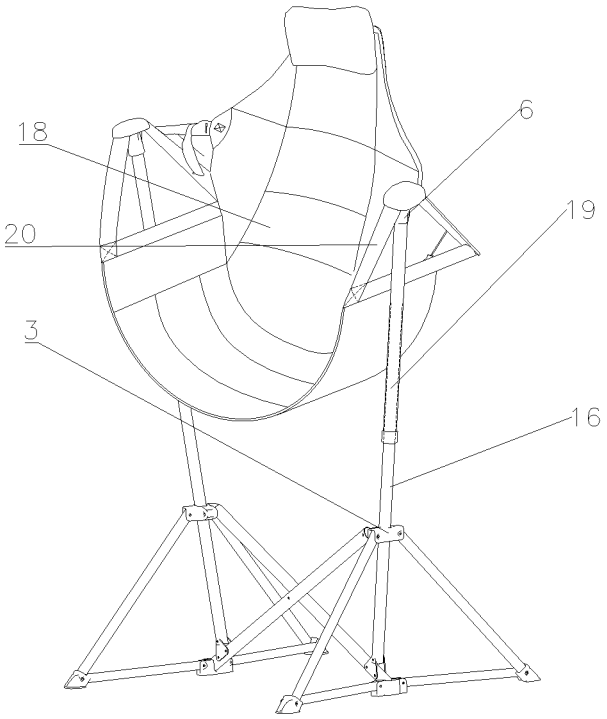
FIG. 3 is a structural view of the folding chair with support posts extended according to the first embodiment of the present invention.
Figure 4:
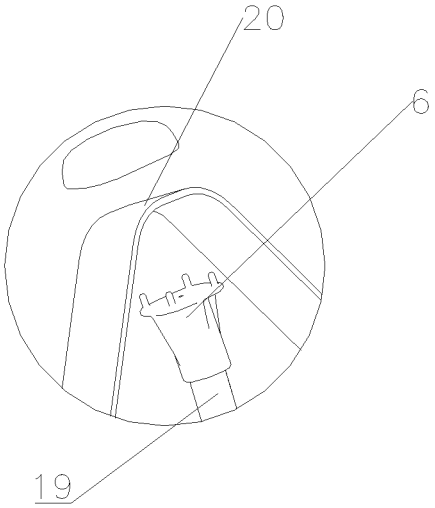
FIG. 4 is a partial view of the folding chair according to the first embodiment of the present invention.
Figure 5:
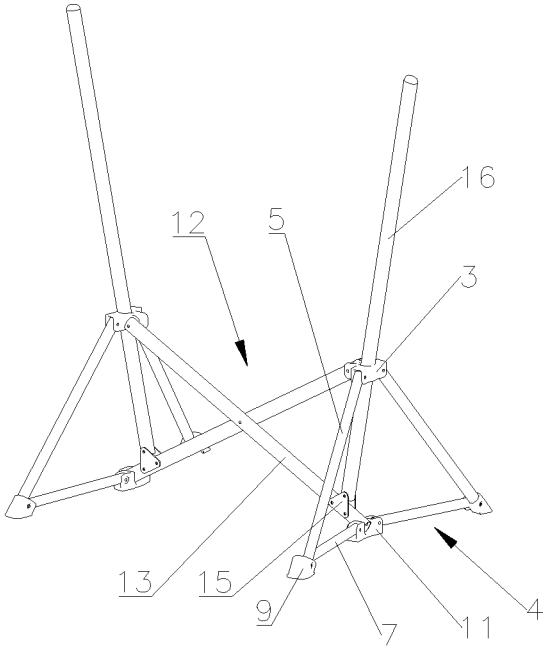
FIG. 5 is a partial view of the folding chair in an unfolded state according to the first embodiment of the present invention.
Figure 6:
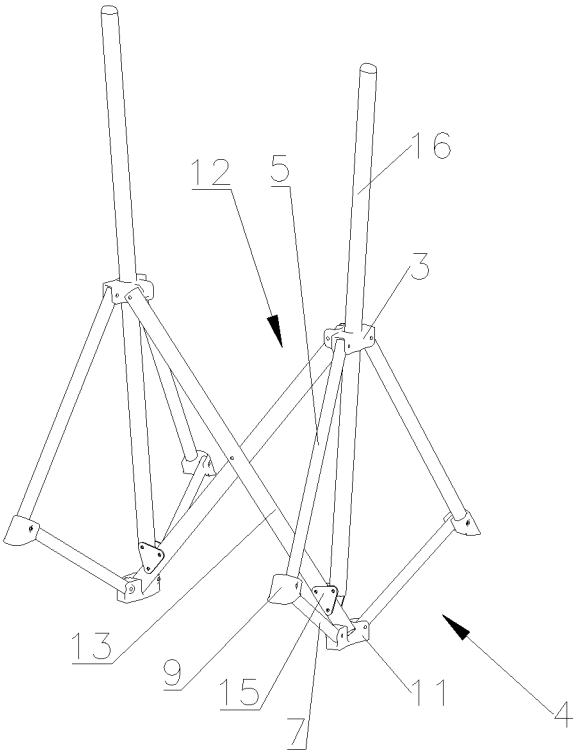
FIG. 6 is a partial view of the folding chair during a folding process according to the first embodiment of the present invention.
Figure 7:
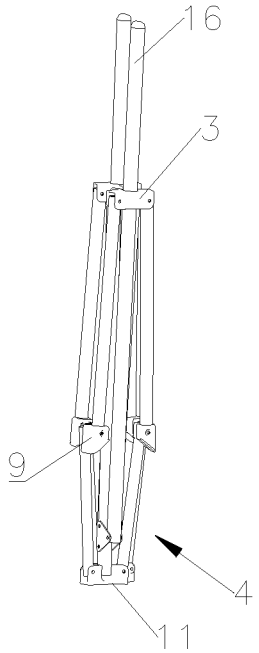
FIG. 7 is a partial view of the folding chair in a folded state according to the first embodiment of the present invention.

Reference Numerals: 1. connecting post; 2. hinge; 3. first connecting member; 4. slant support mechanism; 5. slant support post; 6. sixth connecting member; 7. bottom frame post; 8. eighth connecting member; 9. second connecting member; 10. third connecting member; 11. fourth connecting member; 12. linkage mechanism; 13. linkage post; 14. seventh connecting member; 15. fifth connecting member; 16. standing post; 17. base plate; 18. cushion; 19. support post; 20. hanging strap; 21. limit groove; 22. support groove; 23. fastener; and 24. lock pin.

DETAILED DESCRIPTION OF THE EMBODIMENTS

The embodiments of the present invention are described below in detail. Examples of the embodiments are shown in the drawings. The same or similar numerals represent the same or similar elements or elements having the same or similar functions throughout the specification. The embodiments described below with reference to the drawings are exemplary, and are merely intended to explain the present invention, rather than to limit the present invention.

As shown in FIGS. 1 to 7, a first embodiment of the present invention provides a folding chair. The folding chair includes two mirror-symmetric slant support mechanisms 4 and a linkage mechanism 12 connected between the two slant support mechanisms 4. The slant support mechanisms 4 each include two mirror-symmetric slant support posts 5 and two mirror-symmetric bottom frame posts 7. The linkage mechanism 12 includes two linkage posts 13 that cross each other and are hinged. Upper ends of the two slant support posts 5 and an upper end of a linkage post 13 are hinged to a first connecting member 3. Lower ends of the two slant support posts 5 are respectively hinged to first ends of the two bottom frame posts 7 through second connecting members 9. The second connecting members 9 are fixed to the lower ends of the slant support posts 5 and serve as support bases of the folding chair. The first ends of the bottom frame posts are respectively hinged to the second connecting members 9. Second ends of the two bottom frame posts 7 are hinged to a fourth connecting member 11. A lower end of the linkage post 13 is hinged to the fourth connecting member 11. The folding chair further includes two mirror-symmetric standing posts 16. The first connecting member 3 is slidable on the standing post 16, and the first connecting member 3 is guided by the standing post 16 during movement. A fifth connecting member 15 is fixed to a portion of the linkage post 13 close to the lower end. A lower end of the standing post 16 is hinged to the fifth connecting member 15.

The folding chair further includes a pressing mechanism and a cushion 18. When the folding chair is unfolded and the cushion 18 carries an object, for example, when a user sits on the cushion, the pressing mechanism transmits a weight received by the cushion 18 to the first connecting member 3. In this embodiment, the pressing mechanism includes two support posts 19. The two support posts 19 are respectively supported on two sides of the cushion 18. Hanging straps 20 are connected to two sides of the cushion 18. The support posts 19 are respectively connected to the hanging straps 20 through sixth connecting members 6 to support the hanging straps 20.

The standing posts 16 are inserted into the support posts 19 and the support posts 19 are movable along the standing posts 16. The connection between the standing posts 16 and the support posts 19 is an inserting connection, which facilitates the disassembly and assembly of the support posts 19 and the standing posts 16. It also increases the contact area between the support posts 19 and the standing posts 16, thereby achieving a stable connection between the standing posts 16 and the support posts 19, and improving the structural strength of the folding chair. When the folding chair is unfolded and the cushion 18 carries an object, the support posts 19 support the cushion 18 through the hanging straps 20. The bottom parts of the support posts 19 press the first connecting members 3, and the weight of the object on the cushion 18 and the cushion 18 is transmitted to the first connecting members 3 through the support posts 19, thereby stabilizing the unfolded folding chair. When the folding chair is to be folded, the cushion 18 is removed and the support posts 19 are separated from the first connecting members 3. A force is applied to the two standing posts 16 to bring the two standing posts 16 and the two first connecting members 3 close to each other to complete the folding action.

Figure 8:
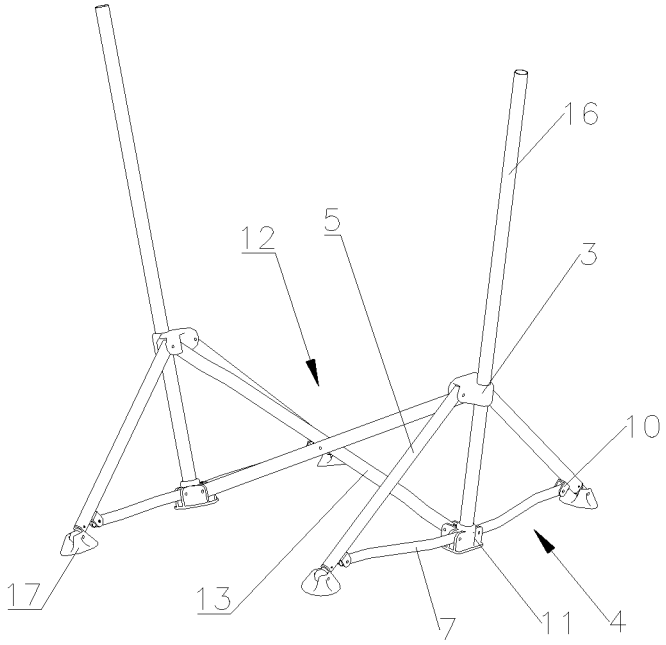
FIG. 8 is a partial view of a folding chair in an unfolded state according to a second embodiment of the present invention.
Figure 9:
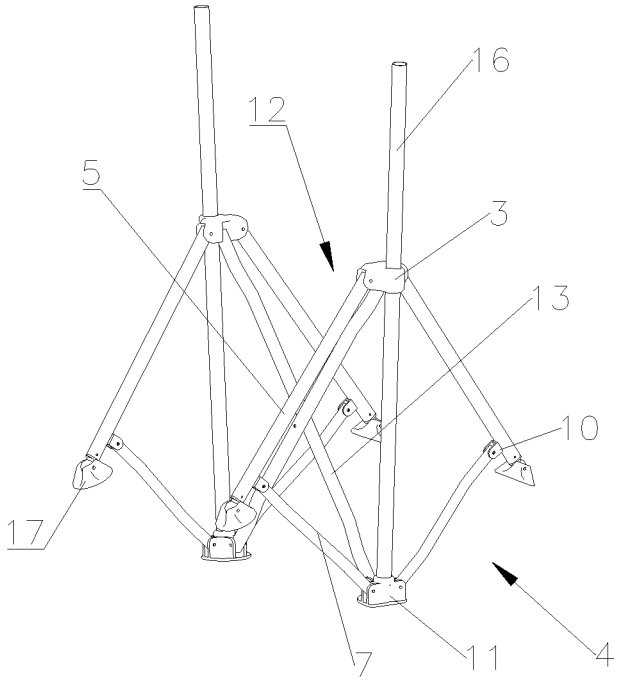
FIG. 9 is a partial view of the folding chair during a folding process according to the second embodiment of the present invention.
Figure 10:
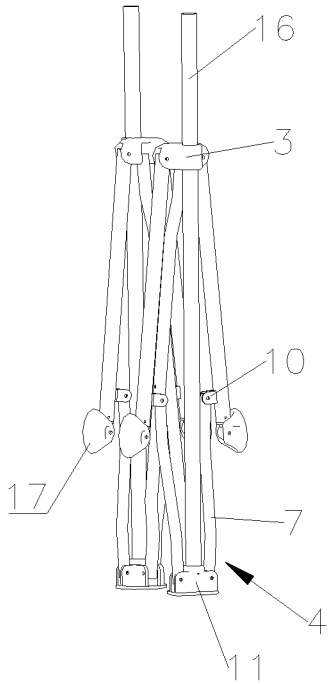
FIG. 10 is a partial view of the folding chair in a folded state according to the second embodiment of the present invention.

As shown in FIGS. 8 to 10, a second embodiment of the present invention provides a folding chair. The second embodiment differs from the first embodiment in that the connection between the support posts 19 and the standing posts 16 is a buckling connection. For example, a buckle (not shown in the figure) is fixed on the standing posts 16, and the support posts 19 are connected to the standing posts 16 through the buckle. The support posts 19 are movable in the buckle, and the support posts 19 and the standing posts 16 are stably connected by the buckle. Lower ends of the standing posts 16 are fixed to fourth connecting members 11. When the folding chair is unfolded and the cushion 18 carries an object, the bottom parts of the support posts 19 press the first connecting members 3 and transmit the weight to the first connecting members 3.

In this embodiment, the folding chair further includes third connecting members 10 and base plates 17. The lower ends of the slant support posts 5 are hinged to the base plates 17. In the first embodiment, the slant support posts 5 and the bottom frame posts 7 are hinged by the second connecting members 9. In this embodiment, the third connecting members 10 are fixed to the slant support posts 5, and the first ends of the bottom frame posts 7 are hinged to the third connecting members 10. When the folding chair is unfolded, bottom end surfaces of the base plate 17 are attached to a ground to support the unfolded folding chair.

Figure 11:
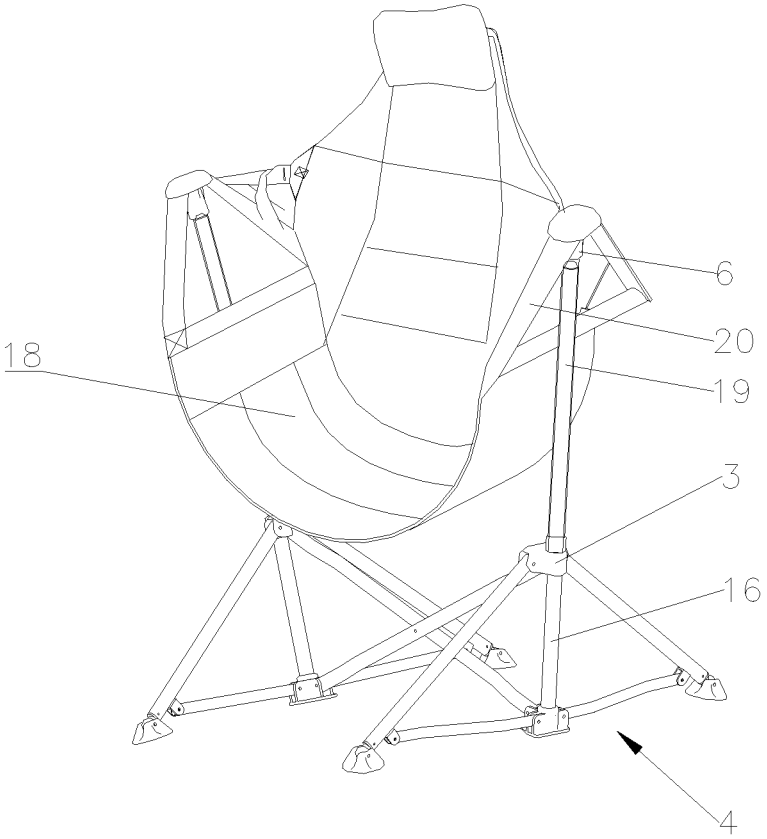
FIG. 11 is a structural view of a folding chair according to a third embodiment of the present invention.
Figure 12:
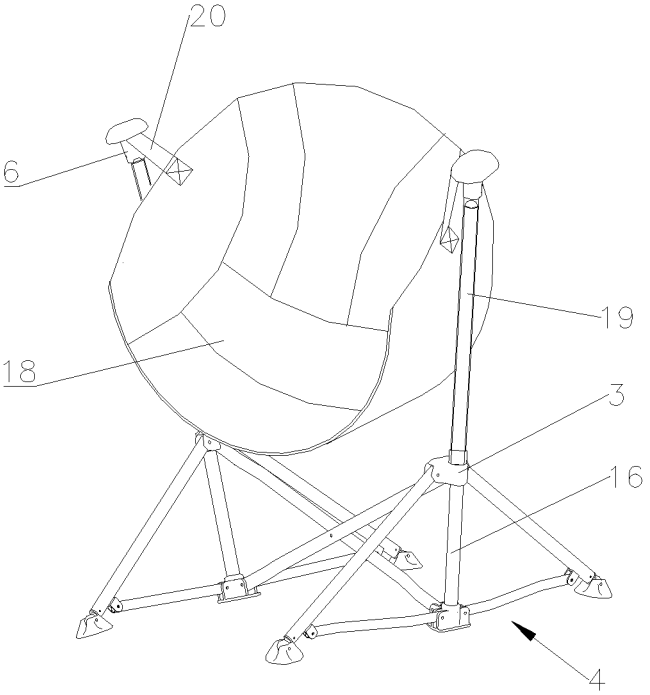
FIG. 12 is a structural view of the folding chair using a different cushion according to the third embodiment of the present invention.
Figure 13:
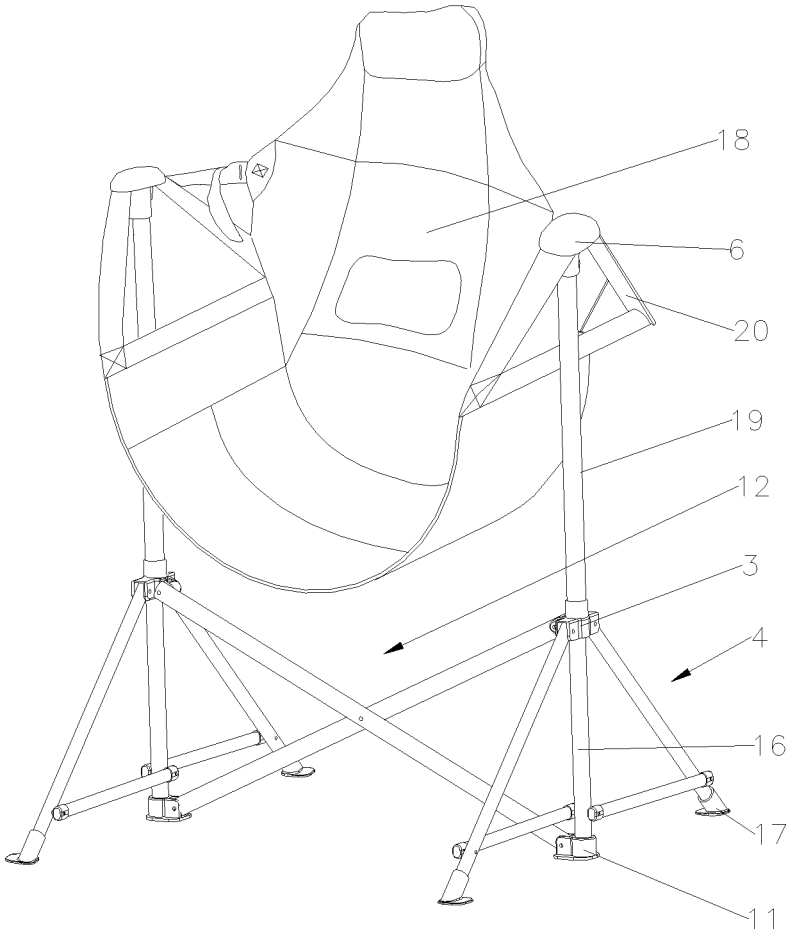
FIG. 13 is a structural view of a folding chair according to a fourth embodiment of the present invention.
Figure 14:
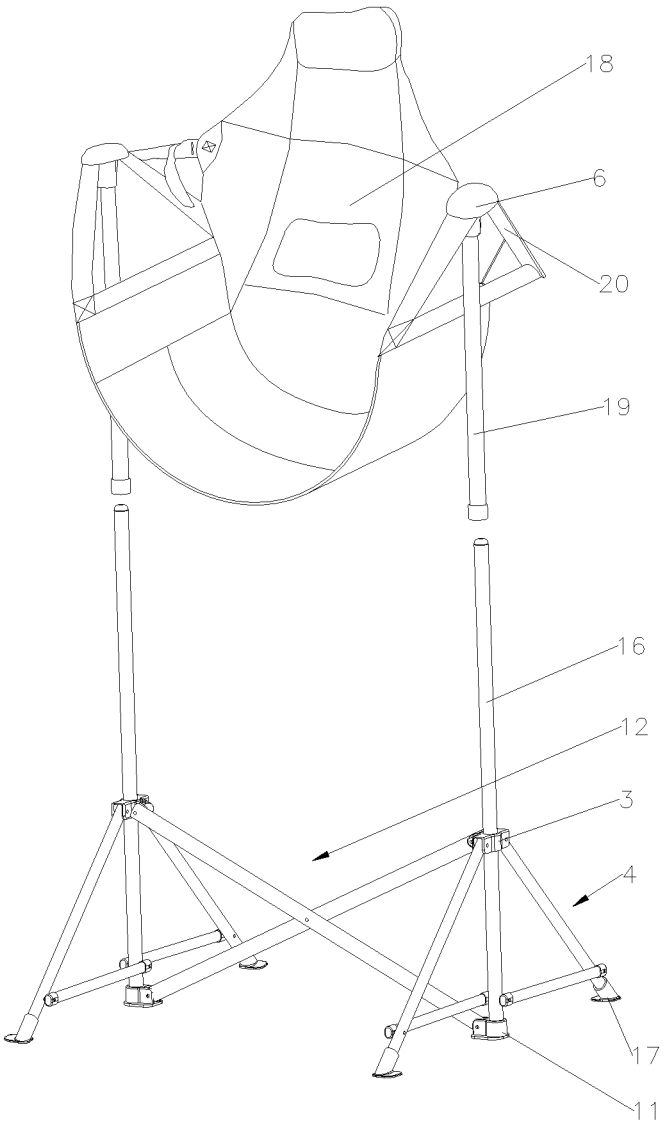
FIG. 14 is a structural view of the folding chair in a disassembled state according to the fourth embodiment of the present invention.
Figure 15:
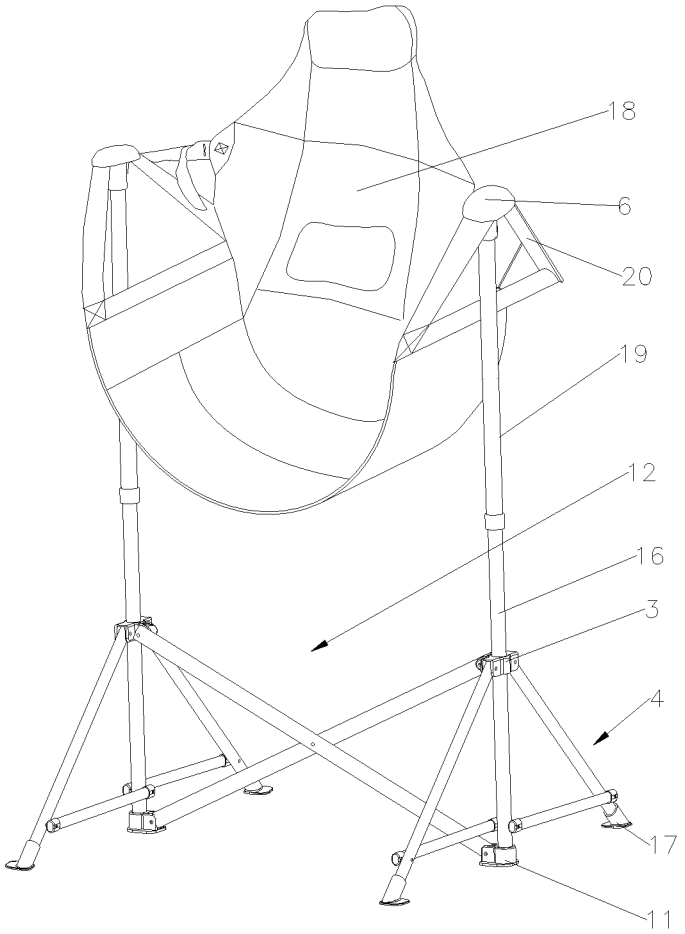
FIG. 15 is a structural view of the folding chair with support posts extended according to the fourth embodiment of the present invention.
Figure 16:
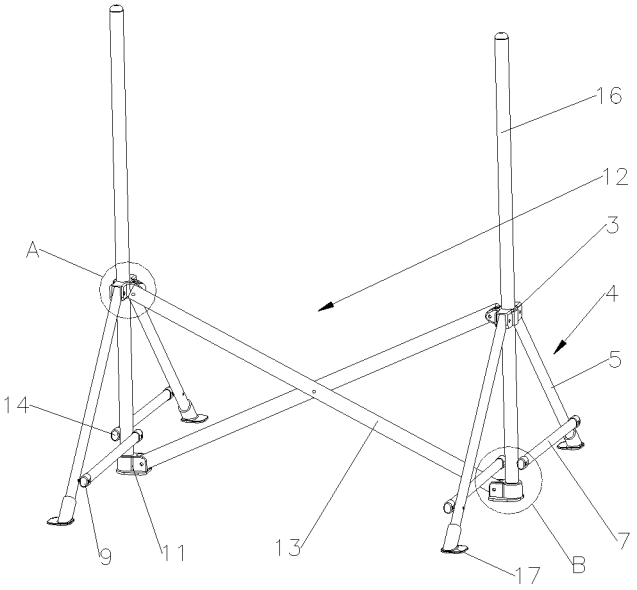
FIG. 16 is a partial view of a folding chair in an unfolded state according to the fourth embodiment of the present invention.
Figure 17:
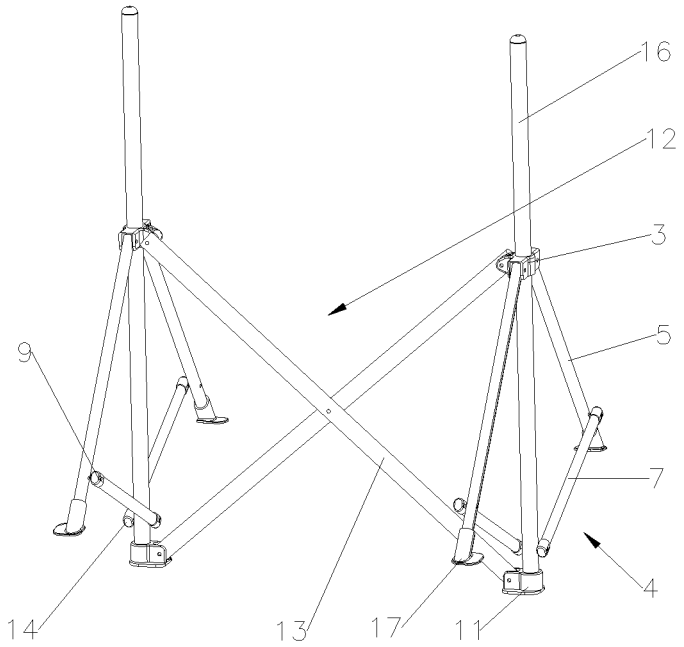
FIG. 17 is a partial view of the folding chair during a folding process according to the fourth embodiment of the present invention.
Figure 18:
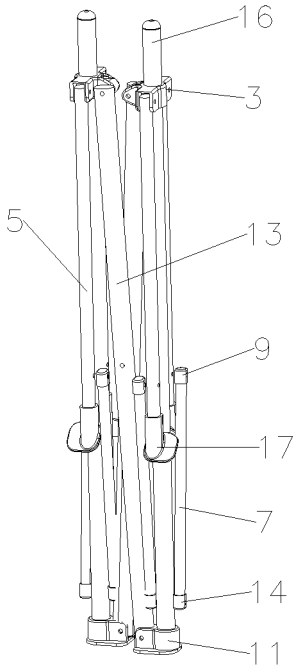
FIG. 18 is a partial view of the folding chair in a folded state according to the fourth embodiment of the present invention.
Figure 19:
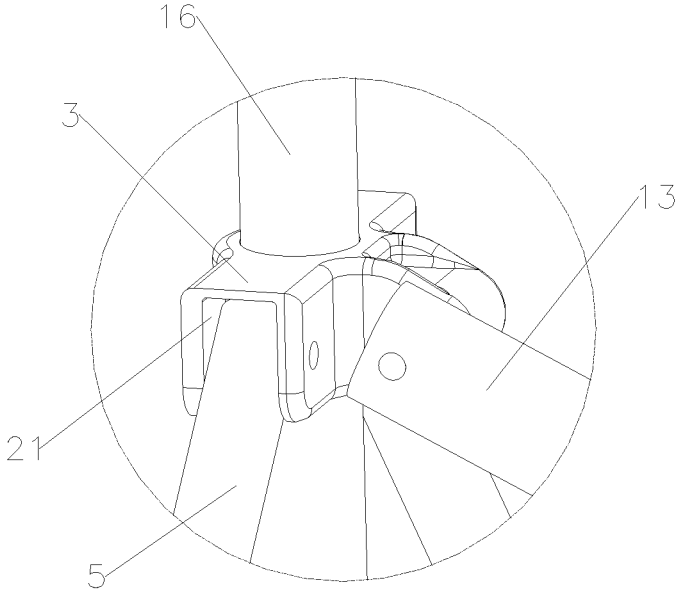
FIG. 19 is a detail view of A in FIG. 16.
Figure 20:
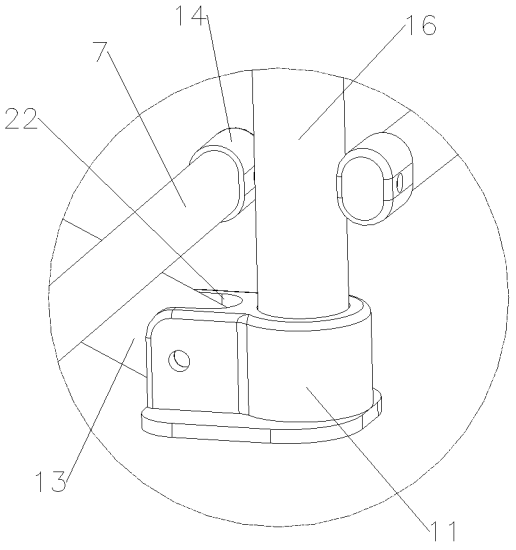
FIG. 20 is a detail view of B in FIG. 16.
Figure 21:
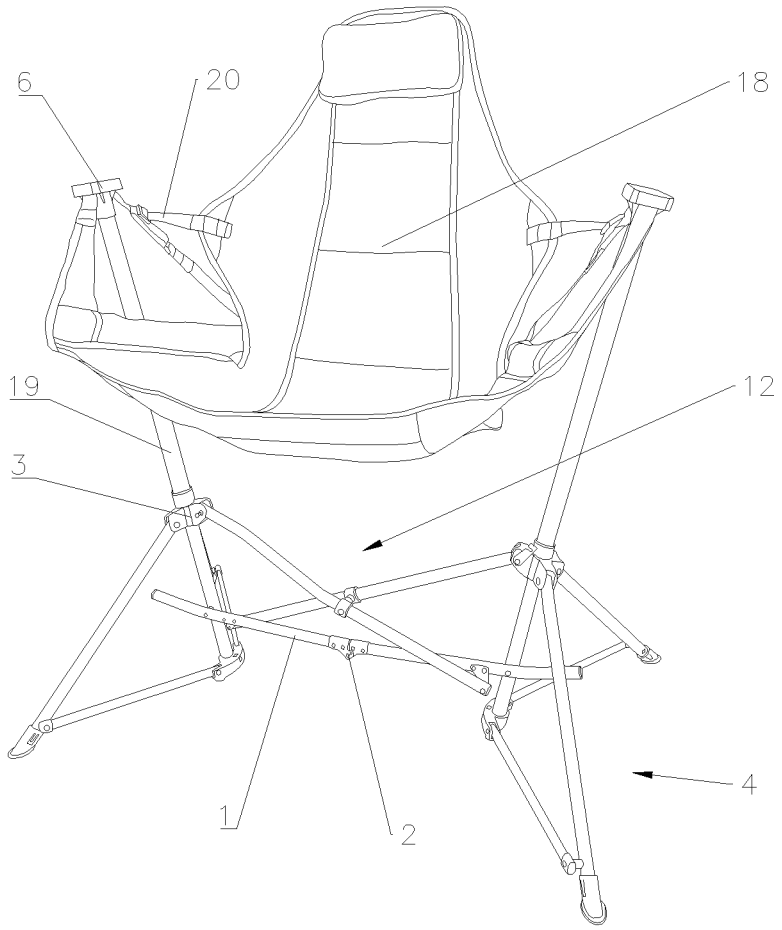
FIG. 21 is a structural view of a folding chair according to a sixth embodiment of the present invention.
Figure 22:
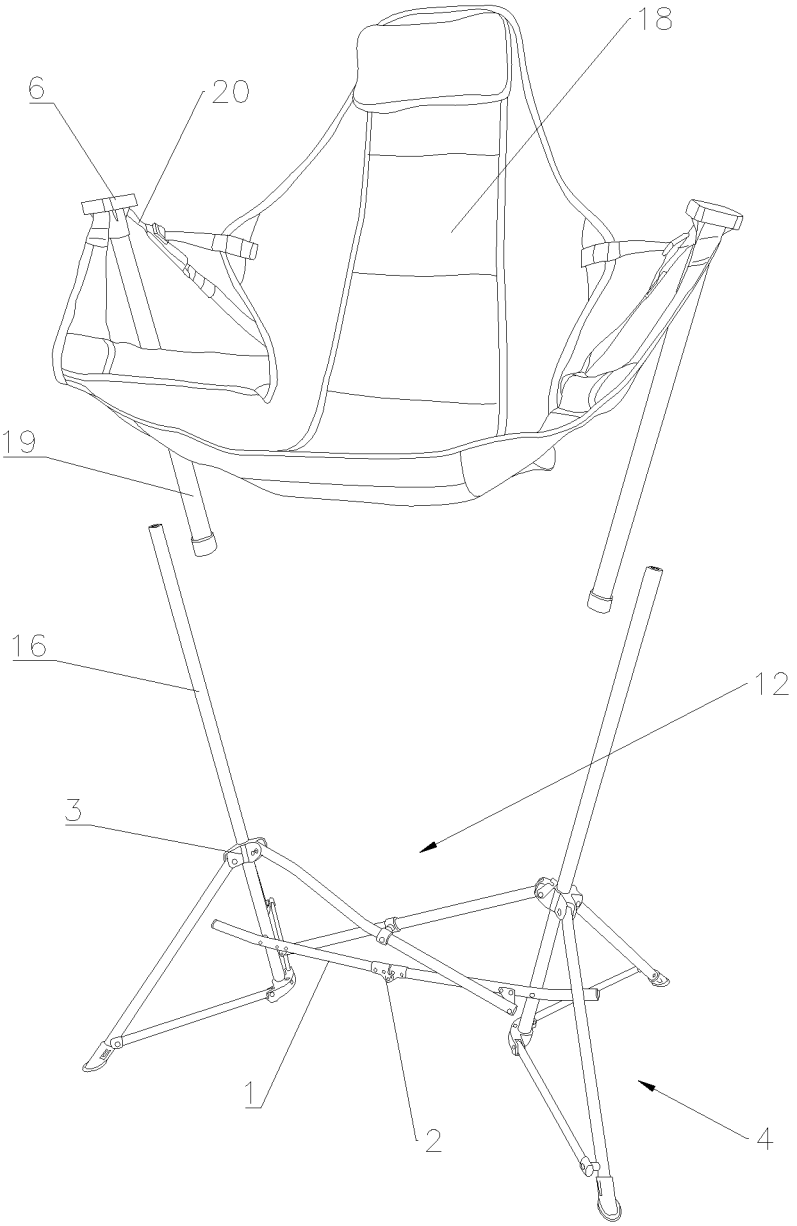
FIG. 22 is a structural view of the folding chair in a disassembled state according to the sixth embodiment of the present invention.
Figure 23:
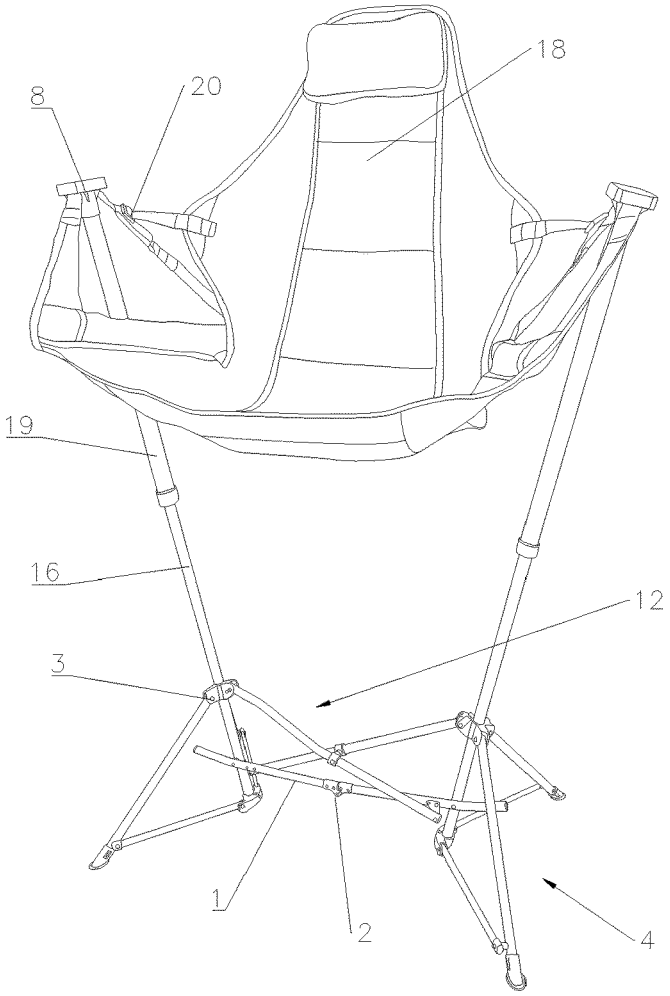
FIG. 23 is a structural view of the folding chair with support posts extended according to the sixth embodiment of the present invention.
Figure 24:
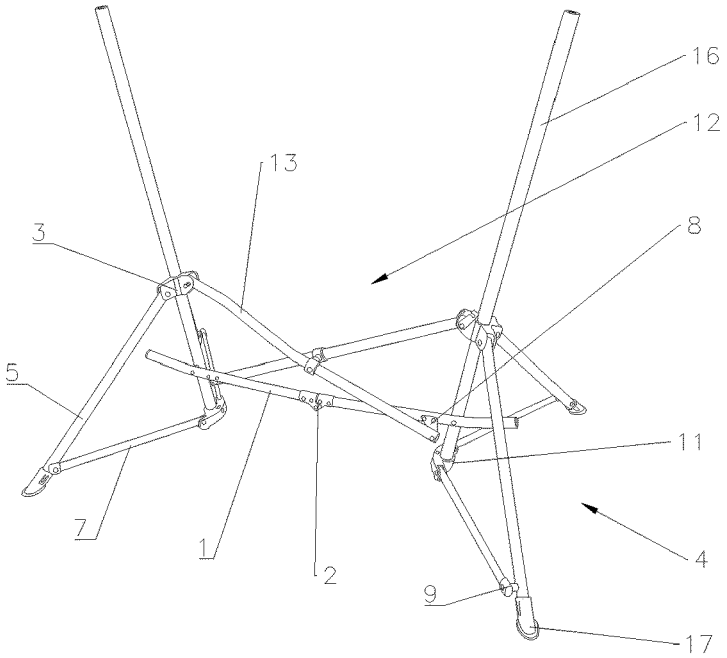
FIG. 24 is a partial view of a folding chair in an unfolded state according to the sixth embodiment of the present invention.
Figure 25:
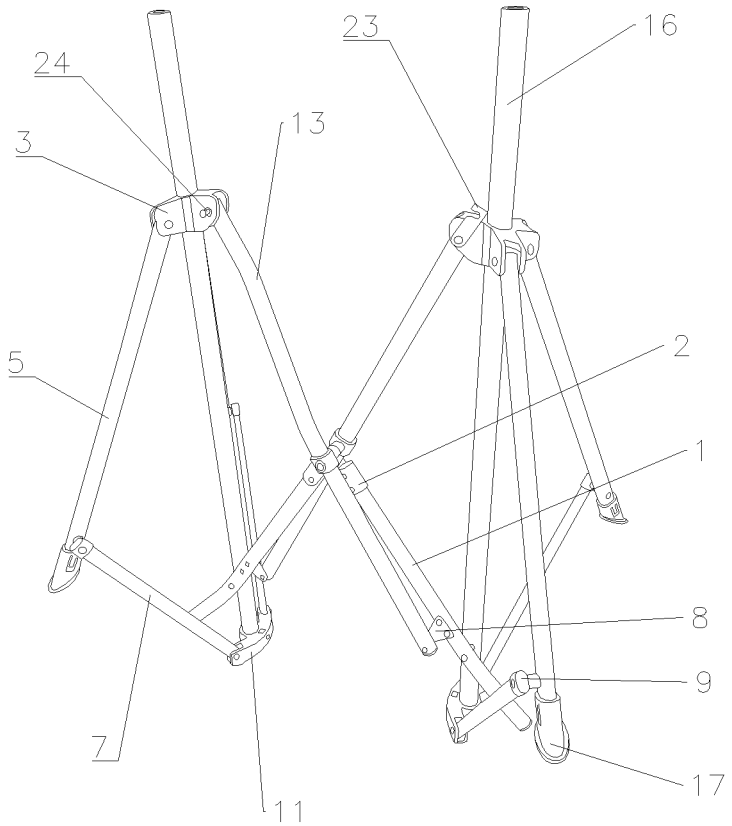
FIG. 25 is a partial view of the folding chair during a folding process according to the sixth embodiment of the present invention.
Figure 26:
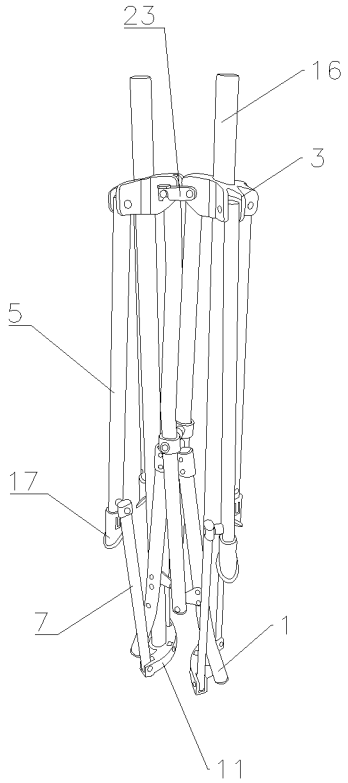
FIG. 26 is a partial view of the folding chair during a folding process according to the sixth embodiment of the present invention.

As shown in FIGS. 11 and 12, a third embodiment of the present invention provides a folding chair. The third embodiment differs from the second embodiment in that the standing posts 16 are inserted into the support posts 19 and the support posts 19 are movable along the standing posts 16. The connection between the standing posts 16 and the support posts 19 is an inserting connection, which stabilizes the connection between the standing posts 16 and the support posts 19 and improves the structural strength of the folding chair. The cushion may be a cushion with a high backrest or a cushion of other forms with a low backrest, so as to fully meet the requirements of different users.

As shown in FIGS. 13 to 20, a fourth embodiment of the present invention provides a folding chair. In the folding chair, the first connecting member 3 is provided with limit grooves 21. The upper ends of the slant support posts 5 are hinged in the limit grooves 21. The limit grooves 21 support and guide the slant support posts 5 to prevent the slant support posts 5 from skewing during use. The fourth connecting member 11 is provided with a support groove 22. The lower end of the linkage post 13 is hinged in the support groove 22, and the support groove 22 supports and guides the linkage post 13, which improves the connection strength between the linkage post 13 and the fourth connecting member 11. The fourth embodiment differs from the first embodiment as follows. The lower end of the standing post 16 is fixed to the fourth connecting member 11. The second connecting member 9 is fixed to the first end of the bottom frame post 7. A portion of the slant support post 5 close to the lower end is hinged to the second connecting member 9. The second end of the bottom frame post 7 is provided with a seventh connecting member 14. The seventh connecting member 14 is hinged to a portion of the standing post 16 close to the lower end.

The folding chair further includes base plates 17. The base plates 17 are fixed to the lower ends of the slant support posts 5. When the folding chair is unfolded, the bottom end surfaces of the base plates 17 are attached to the ground to support the unfolded folding chair.

A fifth embodiment of the present invention further provides a folding chair. The fifth embodiment differs from the fourth embodiment in that the connection between the support posts 19 and the standing posts 16 is a buckling connection. For example, a buckle is fixed on the standing posts 16, and the support posts 19 are connected to the standing posts 16 through the buckle. The support posts 19 are movable in the buckle, and the support posts 19 and the standing posts 16 are stably connected by the buckle. When the folding chair is unfolded and the cushion 18 carries an object, the bottom parts of the support posts 19 press the first connecting members 3.

As shown in FIGS. 21 to 26, a sixth embodiment of the present invention provides a folding chair. The sixth embodiment differs from the first embodiment in that the folding chair further includes two connecting posts 1. The lower ends of the two linkage posts 13 are hinged to the two connecting posts 1 respectively. First ends of the two connecting posts 1 are hinged by a hinge 2. In this embodiment, the lower ends of the linkage posts 13 are respectively hinged to eighth connecting members 8. Portions of the standing posts 16 close to their lower ends are hinged to those of the connecting posts 1 close to their second ends. The eighth connecting members 8 are respectively fixed between the hinge 2 and the standing posts 16 on the connecting posts 1. The lower ends of the standing posts 16 are fixedly connected to the fourth connecting members 11. When the two connecting posts 1 are unfolded, the two connecting posts 1 are connected. Thus, the connecting posts 1 stably support the standing posts 16 to further prevent the two standing posts 16 from approaching each other.

In this embodiment, the folding chair further includes a fastener 23 and a lock pin 24. The fastener 23 and the lock pin 24 are respectively arranged on the two first connecting members 3. That is, one first connecting member 3 is provided with the fastener 23, and the other first connecting member 3 is provided with the lock pin 24 that is fit with the fastener 23. When the two first connecting members 3 are close to each other, the two first connecting members 3 are locked together by the fastener 23 and the lock pin 24 to complete the folding action.

In this embodiment, the folding chair further includes base plates 17. The base plates 17 are fixed to the lower ends of the slant support posts 5. The second connecting members 9 are fixed to the first ends of the bottom frame posts 7. Portions of the slant support posts 5 close to the lower ends thereof are hinged to the second connecting members 9. When the folding chair is unfolded, the bottom end surfaces of the base plates 17 are attached to the ground to support the unfolded folding chair.

A seventh embodiment of the present invention further provides a folding chair. The seventh embodiment differs from the sixth embodiment in that the connection between the support posts 19 and the standing posts 16 is a buckling connection. For example, a buckle is fixed on the standing posts 16, and the support posts 19 are connected to the standing posts 16 through the buckle. The support posts 19 are movable in the buckle, and the support posts 19 and the standing posts 16 are stably connected by the buckle. When the folding chair is unfolded and the cushion 18 carries an object, the bottom parts of the support posts 19 press the first connecting members 3.

Inspired by the above ideal embodiments of the present invention, those skilled in the art can make various changes and modifications through the above description without departing from the scope of the technical idea of the present invention. The technical scope of the present invention is subjected to the scope of the claims, and is not limited to the content of the specification.

What is claimed is:

1. A folding chair, comprising two mirror-symmetric slant support mechanisms and a linkage mechanism connected between the two mirror-symmetric slant support mechanisms, wherein the two mirror-symmetric slant support mechanisms each comprise two slant support posts and two bottom frame posts; the linkage mechanism comprises two linkage posts, the two linkage posts cross each other and are hinged; upper ends of the two slant support posts and an upper end of one of the two linkage posts are hinged to one of first connecting members; first ends of the two bottom frame posts are respectively hinged to the two slant support posts, and second ends of the two bottom frame posts are hinged; lower ends of the two linkage posts are respectively connected to the two mirror-symmetric slant support mechanisms; the folding chair further comprises a pressing mechanism and a cushion; and when the folding chair is unfolded and the cushion carries an object, the pressing mechanism transmits a weight received by the cushion to the first connecting members;

wherein the second ends of the two bottom frame posts are hinged to one of fourth connecting members, and the lower ends of the two linkage posts are respectively hinged to the fourth connecting members;

wherein the folding chair further comprises two mirror-symmetric standing posts; the first connecting members are respectively slidable on the two mirror-symmetric standing posts; the pressing mechanism comprises two support posts; the two support posts are respectively supported on two sides of the cushion; and the two support posts are respectively connected to the two mirror-symmetric standing posts and transmit the weight received by the cushion to the first connecting members; and wherein the two mirror-symmetric standing posts are respectively inserted into the two support posts, and the two support posts are movable along the two mirror-symmetric standing posts; and when the folding chair is unfolded and the cushion carries the object, bottom parts of the two support posts respectively press the first connecting members.

2. The folding chair according to claim 1, wherein the two mirror-symmetric standing posts are respectively provided with buckles; the two support posts are respectively connected to the two mirror-symmetric standing posts through the buckles, and the two support posts are movable in the buckles; and when the folding chair is unfolded and the cushion carries the object, bottom parts of the two support posts respectively press the first connecting members.

3. The folding chair according to claim 2, wherein the two linkage posts are respectively fixed with fifth connecting members at portions adjacent to the lower ends of the two linkage posts; and lower ends of the two mirror-symmetric standing posts are respectively hinged to the fifth connecting members.

4. The folding chair according to claim 3, wherein hanging straps are connected to the two sides of the cushion; and the two support posts are respectively connected to the hanging straps through sixth connecting members to support the hanging straps.

5. The folding chair according to claim 4, wherein the folding chair further comprises second connecting members; and lower ends of the two slant support posts are respectively hinged to the first ends of the two bottom frame posts through the second connecting members.

6. The folding chair according to claim 2, wherein lower ends of the two mirror-symmetric standing posts are respectively fixed to the fourth connecting members.

7. The folding chair according to claim 6, wherein hanging straps are connected to the two sides of the cushion; and the two support posts are respectively connected to the hanging straps through sixth connecting members to support the hanging straps.

8. The folding chair according to claim 7, wherein the folding chair further comprises third connecting members and base plates; lower ends of the two slant support posts are respectively hinged to the base plates; the third connecting members are respectively fixed to the two slant support posts; and the first ends of the two bottom frame posts are respectively hinged to the third connecting members.

9. The folding chair according to claim 1, wherein the two linkage posts are respectively fixed with fifth connecting members at portions adjacent to the lower ends of the two linkage posts; and lower ends of the two mirror-symmetric standing posts are respectively hinged to the fifth connecting members.

10. The folding chair according to claim 9, wherein hanging straps are connected to the two sides of the cushion; and the two support posts are respectively connected to the hanging straps through sixth connecting members to support the hanging straps.

11. The folding chair according to claim 10, wherein the folding chair further comprises second connecting members; and lower ends of the two slant support posts are respectively hinged to the first ends of the two bottom frame posts through the second connecting members.

12. The folding chair according to claim 1, wherein lower ends of the two mirror-symmetric standing posts are respectively fixed to the fourth connecting members.

13. The folding chair according to claim 12, wherein hanging straps are connected to the two sides of the cushion; and the two support posts are respectively connected to the hanging straps through sixth connecting members to support the hanging straps.

14. The folding chair according to claim 13, wherein the folding chair further comprises third connecting members and base plates; lower ends of the two slant support posts are respectively hinged to the base plates; the third connecting members are respectively fixed to the two slant support posts; and the first ends of the two bottom frame posts are respectively hinged to the third connecting members.

15. The folding chair according to claim 1, wherein the folding chair further comprises two mirror-symmetric standing posts and fourth connecting members; the second ends of the two bottom frame posts are hinged to portions of the two mirror-symmetric standing posts adjacent to a lower end; and the lower ends of the two linkage posts are respectively hinged to the fourth connecting members.

16. The folding chair according to claim 15, wherein the first connecting members are respectively slidable on the two mirror-symmetric standing posts; the pressing mechanism comprises two support posts; the two support posts are respectively supported on two sides of the cushion; and the two support posts are respectively connected to the two mirror-symmetric standing posts and transmit the weight received by the cushion to the first connecting members.

17. The folding chair according to claim 16, wherein the two mirror-symmetric standing posts are respectively provided with buckles; the two support posts are respectively connected to the two mirror-symmetric standing posts through the buckles, and the two support posts are movable in the buckles; and when the folding chair is unfolded and the cushion carries the object, bottom parts of the two support posts respectively press the first connecting members.

18. The folding chair according to claim 17, wherein the first connecting members each are provided with limit grooves, and the upper ends of the two slant support posts are respectively hinged in the limit grooves.

19. The folding chair according to claim 18, wherein lower ends of the two mirror-symmetric standing posts are respectively fixed to the fourth connecting members.

20. The folding chair according to claim 19, wherein hanging straps are connected to the two sides of the cushion; and the two support posts are respectively connected to the hanging straps through sixth connecting members to support the hanging straps.

21. The folding chair according to claim 20, wherein the two mirror-symmetric slant support mechanisms each further comprise second connecting members and a seventh connecting member; the second connecting members are respectively fixed to the first ends of the two bottom frame posts; portions of the two slant support posts adjacent to lower ends of the two slant support posts are respectively hinged to the second connecting members; each of the seventh connecting members is fixed to the second ends of the two bottom frame posts; portions of the two mirror-symmetric standing posts adjacent to the lower ends of the two mirror-symmetric standing posts are respectively hinged to the seven connecting members.

22. The folding chair according to claim 21, wherein the fourth connecting members are respectively provided with support grooves, and the lower ends of the two linkage posts are respectively hinged in the support grooves.

23. The folding chair according to claim 22, wherein the folding chair further comprises base plates fixed to the lower ends of the two slant support posts.

24. The folding chair according to claim 1, wherein the second ends of the two bottom frame posts are hinged to one of fourth connecting members; the folding chair further comprises two connecting posts; the lower ends of the two linkage posts are respectively hinged to the two connecting posts; and first ends of the two connecting posts are hinged by a hinge.

25. The folding chair according to claim 24, wherein the folding chair further comprises two mirror-symmetric standing posts; the first connecting members are respectively slidable on the two mirror-symmetric standing posts; the pressing mechanism comprises two support posts; the two support posts are respectively supported on two sides of the cushion; and the two support posts are respectively connected to the two mirror-symmetric standing posts and transmit the weight received by the cushion to the first connecting members.

26. The folding chair according to claim 25, wherein the two mirror-symmetric standing posts are respectively inserted into the two support posts, and the two support posts are movable along the two mirror-symmetric standing posts; and when the folding chair is unfolded and the cushion carries the object, bottom parts of the two support posts respectively press the first connecting members.

27. The folding chair according to claim 26, wherein the lower ends of the two linkage posts are respectively hinged to eighth connecting members; the eighth connecting members are respectively fixed to the two connecting posts; and the two mirror-symmetric standing posts are respectively hinged to the two connecting posts.

28. The folding chair according to claim 27, wherein lower ends of the two mirror-symmetric standing posts are respectively fixedly connected to the fourth connecting members.

29. The folding chair according to claim 28, wherein hanging straps are connected to the two sides of the cushion; and the two support posts are respectively connected to the hanging straps through sixth connecting members to support the hanging straps.

30. The folding chair according to claim 29, wherein the two mirror-symmetric slant support mechanisms each further comprise second connecting members and base plates; the base plates are respectively fixed to lower ends of the two slant support posts; the second connecting members are respectively fixed to the first ends of the two bottom frame posts; portions of the two slant support posts adjacent to the lower ends of the two slant support posts are respectively hinged to the second connecting members.

31. The folding chair according to claim 30, wherein the folding chair further comprises a fastener and a lock pin; and the fastener and the lock pin are respectively arranged on the two first connecting members.

32. The folding chair according to claim 25, wherein the two mirror-symmetric standing posts are respectively provided with buckles; the two support posts are respectively connected to the two mirror-symmetric standing posts through the buckles, and the two support posts are movable in the buckles; and when the folding chair is unfolded and the cushion carries the object, bottom parts of the two support posts respectively press the first connecting members.

33. The folding chair according to claim 32, wherein the lower ends of the two linkage posts are respectively hinged to eighth connecting members; the eighth connecting members are respectively fixed to the two connecting posts; and the two mirror-symmetric standing posts are respectively hinged to the two connecting posts.

34. The folding chair according to claim 33, wherein lower ends of the two mirror-symmetric standing posts are respectively fixedly connected to the fourth connecting members.

35. The folding chair according to claim 34, wherein hanging straps are connected to the two sides of the cushion; and the two support posts are respectively connected to the hanging straps through sixth connecting members to support the hanging straps.

36. The folding chair according to claim 35, wherein the two mirror-symmetric slant support mechanisms each further comprise second connecting members and base plates; the base plates are respectively fixed to lower ends of the two slant support posts; the second connecting members are respectively fixed to the first ends of the two bottom frame posts; portions of the two slant support posts adjacent to the lower ends of the two slant support posts are respectively hinged to the second connecting members.

37. The folding chair according to claim 36, wherein the folding chair further comprises a fastener and a lock pin; and the fastener and the lock pin are respectively arranged on the two first connecting members.

38. A folding chair, comprising two mirror-symmetric slant support mechanisms and a linkage mechanism connected between the two mirror-symmetric slant support mechanisms, wherein the two mirror-symmetric slant support mechanisms each comprise two slant support posts and two bottom frame posts; the linkage mechanism comprises two linkage posts, the two linkage posts cross each other and are hinged; upper ends of the two slant support posts and an upper end of one of the two linkage posts are hinged to one of first connecting members; first ends of the two bottom frame posts are respectively hinged to the two slant support posts, and second ends of the two bottom frame posts are hinged; lower ends of the two linkage posts are respectively connected to the two mirror-symmetric slant support mechanisms; the folding chair further comprises a pressing mechanism and a cushion; and when the folding chair is unfolded and the cushion carries an object, the pressing mechanism transmits a weight received by the cushion to the first connecting members;

wherein the folding chair further comprises two mirror-symmetric standing posts and fourth connecting members; the second ends of the two bottom frame posts are hinged to portions of the two mirror-symmetric standing posts adjacent to a lower end; and the lower ends of the two linkage posts are respectively hinged to the fourth connecting members;

wherein the first connecting members are respectively slidable on the two mirror-symmetric standing posts; the pressing mechanism comprises two support posts; the two support posts are respectively supported on two sides of the cushion; and the two support posts are respectively connected to the two mirror-symmetric standing posts and transmit the weight received by the cushion to the first connecting members; and wherein the two mirror-symmetric standing posts are respectively inserted into the two support posts, and the two support posts are movable along the two mirror-symmetric standing posts; and when the folding chair is unfolded and the cushion carries the object, bottom parts of the two support posts respectively press the first connecting members.

39. The folding chair according to claim 38, wherein the first connecting members each are provided with limit grooves, and the upper ends of the two slant support posts are respectively hinged in the limit grooves.

40. The folding chair according to claim 39, wherein lower ends of the two mirror-symmetric standing posts are respectively fixed to the fourth connecting members.

41. The folding chair according to claim 40, wherein hanging straps are connected to the two sides of the cushion; and the two support posts are respectively connected to the hanging straps through sixth connecting members to support the hanging straps.

42. The folding chair according to claim 41, wherein the two mirror-symmetric slant support mechanisms each further comprise second connecting members and a seventh connecting member; the second connecting members are respectively fixed to the first ends of the two bottom frame posts; portions of the two slant support posts adjacent to lower ends of the two slant support posts are respectively hinged to the second connecting members; each of the seventh connecting members is fixed to the second ends of the two bottom frame posts; portions of the two mirror-symmetric standing posts adjacent to the lower ends of the two mirror-symmetric standing posts are respectively hinged to the seven connecting members.

43. The folding chair according to claim 42, wherein the fourth connecting members are respectively provided with support grooves, and the lower ends of the two linkage posts are respectively hinged in the support grooves.

44. The folding chair according to claim 43, wherein the folding chair further comprises base plates fixed to the lower ends of the two slant support posts.

* * * * *